US005535668A

United States Patent [19]

Besaw et al.

[11] Patent Number: 5,535,668

[45] Date of Patent: Jul. 16, 1996

[54] CORRUGATED PALLET

[75] Inventors: Larry G. Besaw, Jasper, Ind.; Timothy R. Farley, Henderson, Ky.

[73] Assignee: The Servants, Inc., Jasper, Ind.

[21] Appl. No.: 169,317

[22] Filed: Dec. 17, 1993

[51] Int. Cl.[6] ..... B65D 19/00

[52] U.S. Cl. ..... 108/51.3; 108/56.3

[58] Field of Search ..... 108/51.3, 56.3, 108/56.1, 51.1

[56] References Cited

U.S. PATENT DOCUMENTS

| | | | |
|---|---|---|---|
| 2,507,588 | 5/1950 | Brandon . | |
| 2,528,413 | 10/1950 | Budd . | |
| 2,631,724 | 3/1953 | Wright | 108/51.3 X |
| 2,888,221 | 5/1959 | Connelly . | |
| 2,908,464 | 10/1959 | Traudt et al. | 108/51.3 |
| 2,925,978 | 2/1960 | Marso | 108/56.3 |
| 2,953,339 | 9/1960 | Roshon | 108/56.3 X |
| 2,996,276 | 8/1961 | Sorenson et al. | 108/51.3 |
| 3,055,624 | 9/1962 | Wilson . | |
| 3,071,045 | 1/1963 | Budd . | |
| 3,272,158 | 9/1966 | Baruum . | |
| 3,362,867 | 1/1968 | Wilkins . | |
| 3,407,758 | 10/1968 | Simkins . | |
| 3,520,258 | 7/1970 | Shepherd . | |
| 3,557,719 | 1/1971 | Gielas . | |
| 3,628,469 | 12/1971 | Neitzke | 108/51.3 |
| 4,015,544 | 4/1977 | Szatkowski . | |
| 4,228,744 | 10/1980 | Moore . | |
| 4,487,136 | 12/1984 | Beckway . | |
| 4,697,699 | 10/1987 | Schneider . | |
| 4,850,284 | 7/1989 | De Groot et al. . | |
| 5,129,329 | 7/1992 | Clasen | 108/51.3 |
| 5,285,732 | 2/1994 | Gottlieb | 108/51.3 |
| 5,329,861 | 7/1994 | McCarthy | 108/51.3 |

FOREIGN PATENT DOCUMENTS

| | | | |
|---|---|---|---|
| 2676711 | 11/1992 | France | 108/51.3 |
| 457272 | 7/1968 | Switzerland | 108/51.3 |
| 697232 | 9/1953 | United Kingdom | 108/51.3 |

*Primary Examiner*—José V. Chen

*Attorney, Agent, or Firm*—Middleton & Reutlinger; David W. Carrithers

[57] ABSTRACT

A lightweight, high strength disposable or recyclable corrugated pallet. The corrugated pallet is formed from one or more sheets of flat corrugated material, at least one of which is scored and cut to form a plurality of spaced apart opposing panels. The panels are hingeably connected to the primary sheet and folded downwardly normal to the bottom surface of the sheet(s) defining a pair of opposing panel support legs. A generally square aperture is formed in the surface of the sheet upon folding of the panels. A support member complementary sized and shaped according to the aperture formed in the sheet and the length of the opposing panel support legs is inserted through the aperture and secured between the pair of opposing panel support legs, preferably with an adhesive. The support member is formed from one or more layers of a narrow strip of corrugated material having a plurality of scores cut therein along the surface of one side for bending said strip into a generally square configuration. The flutes of the corrugated material comprising the support member and opposing panel support legs are oriented in the vertical plane to maximize the strength to weight ratio.

29 Claims, 15 Drawing Sheets

CORRUGATED PALLET

BACKGROUND OF THE INVENTION

The present invention relates to pallets upon which materials are stacked for storage and transportation.

Pallets are used as a method of handling materials in large quantities. Pallets typically comprise a flat surface for supporting containers or packages a sufficient distance from the floor to permit the tines of the lift truck forks to be inserted under them so that the pallet supporting the load can be moved from place to place. Pallets used for this purpose are fabricated from wood, metal, plastic, or combinations thereof. Conventional pallets fabricated from these materials are expensive to make and use due to the cost of the materials, cost of construction, and cost of disposal. Usually these conventional types of pallets have to be returned after the shipment to the shipper for reuse or the pallets had to be disposed of in a proper manner. Deposal of the conventional wood and nail pallets is a problem after exposure to chemical or biochemical materials which contaminate the pallet in that not all of the pallet materials of construction are destructible by incineration and often must be disposed in a hazardous waste landfill which is inconvenient and expensive.

The present invention eliminates several of the disadvantages associated with the use of permanent pallets. The present invention is comprised of inexpensive materials such as corrugated board or paperboard and an adhesive such as glue all of which may be generally recognized as safe, "GRAS", by the Food and Drug Administration, "FDA", so that they are recyclable, disposable in sanitary landfills, and inexpensive to manufacture. The corrugated pallet of the present invention is also easy to dispose of in case of contamination due to product spills or damage because all of the materials of construction are biodegradable and/or can be incinerated without further disassembly, yet they are reusable for many purposes. The corrugated pallets are light in weight and have great structural strength. Thus, the corrugated pallets of the instant invention are especially suited for assembly line work for containing or supporting parts which must be supported or stacked in that the worker need not have to handle the weight of a traditional wood and nail pallet. Moreover, the manufacturer does not have the expense of providing a light weight plastic pallet which are usually too costly to use for operations requiring disposal or destruction of the pallet due to contamination.

Accordingly, it is a principal object of the present invention to provide a disposable and recyclable corrugated pallet of the lowest possible cost while maximizing its strength and durability.

It is an object of the present invention to provide a disposable pallet capable of manufacture solely from lightweight sheet material such as corrugated board and an adhesive.

It is an object of the present invention to provide leg support members comprised of corrugated material to support the pallet high enough above a surface to accommodate the tines of a fork lift.

It is another object of the present invention to construct the pallet with the supporting members being positioned to dissipate the weight of the load on the pallet evenly.

It is yet another object to construct the pallet so that it will sustain loads to which it is subjected and not fold or bend sideways in movement or shipment.

SUMMARY OF THE INVENTION

In order to provide a corrugated pallet having the above characteristics, the present invention comprises at least one flat sheet of single or double ply corrugated material supported by a plurality of supporting members or legs formed from corrugated material. "I" shaped perforations are formed and interconnected with straight score lines along a template formed in the flat sheet of material. Aligning and pressing the support members through the primary sheet detaches the cut portions of the panels integrally formed therein which biases the panels against opposite sides of the support members. Coating of the template prior to insertion of the support members through the panel formed in the primary sheet provides a means of simultaneously applying an adhesive between the panels and the support members.

More particularly, the present invention entails a corrugated pallet comprising a primary sheet of flat corrugated material having a plurality of opposing panels formed therein. The opposing panels are hingeably connected to the primary sheet. Each of the opposing panels are folded downward normal to the surface of the primary panel to define a supporting leg. A support member is fastened in between or around each of the support legs, wherein the support member comprises a strip of corrugated material having a plurality of scores cut therein for bending the strip into a square or block complementary sized for insertion into or around the supporting legs, and extending the length of the supporting legs. Moreover, a means such as an adhesive is provided for fastening the support members to the support legs providing multiple layers of single or multiple ply corrugated material for supporting the load bearing primary panel.

BRIEF DESCRIPTION OF THE DRAWINGS

A better understanding of the present invention will be had upon reference to the following description in conjunction with the accompanying drawings in which like numerals refer to like parts throughout the several views and wherein.

SPECIFICATION

The corrugated pallet 10 of the present invention is designed using one of more layers of single or multiple plys of semi-rigid material such as corrugated board, fiberboard, corrugated plastic sheets for the fabrication of inexpensive disposable skids. It is contemplated that the sheet material may be coated with oil, wax, or a polymer film to repel moisture. The semi-rigid material is typically cut into sheets and strips of material fastened together preferably with an adhesive, such as a glue, or by staples, rivets, or other fastening means. The sheet material is fed into a die which makes the cuts and score lines for the number of foldable panel legs required for the load capacity of a particular pallet.

Figure 1:
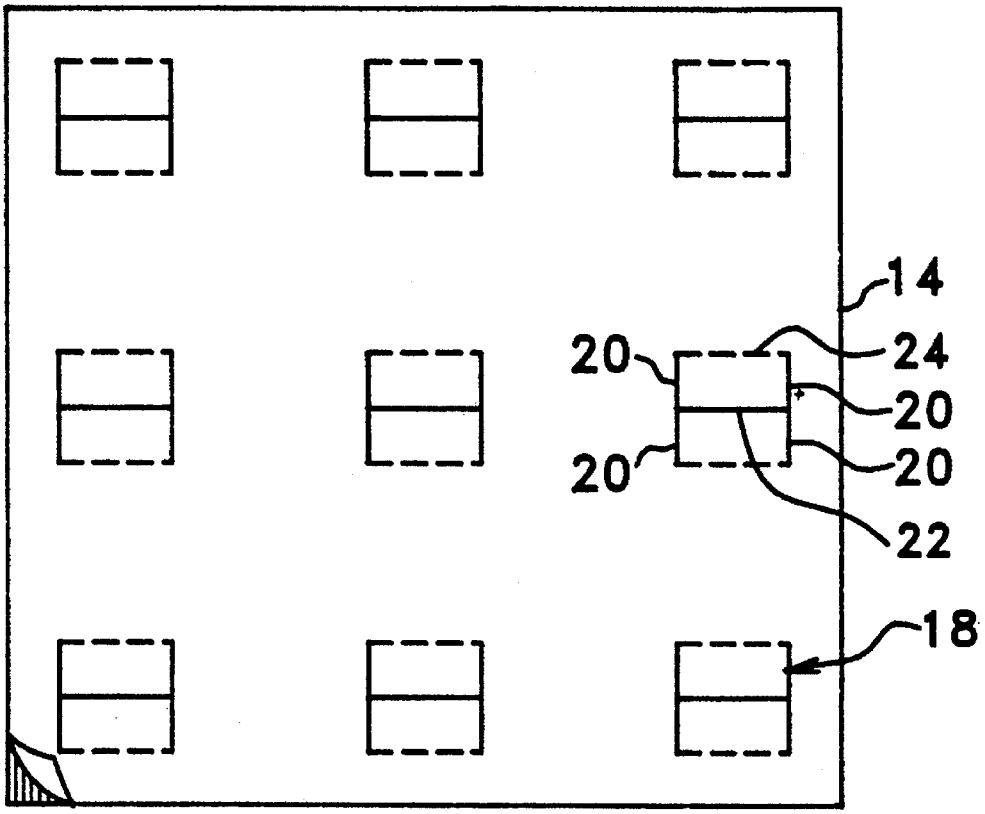
FIG. 1 plan top view showing the perforations cut through and scores lines formed in the surface of a corrugated sheet of material forming a template in the primary sheet of the present invention.
Figure 2:
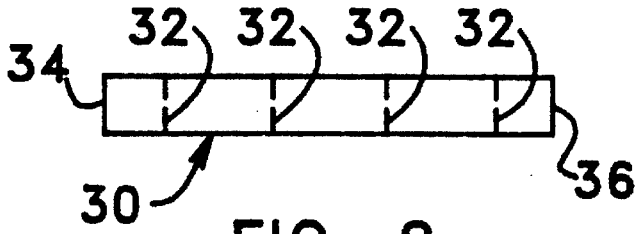
FIG. 2 is a front plan view showing a strip of corrugated material having a plurality of perforations and scores therein for foldably forming a support member of the present invention.
Figure 3:
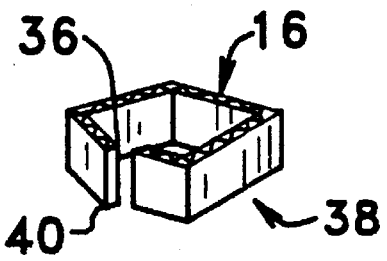
FIG. 3 is an elevational perspective view of a support member of the present invention.

As shown in FIGS. 1–9, the present invention comprises a corrugated pallet 12 having at least one first primary sheet 14 comprising a single sheet of fluted single, double, triple, quadruple, or multiple plys of corrugated board supported by a plurality of opposing support leg members 16 FIG. 1 shows the primary sheet 14 of one preferred embodiment including a plurality of foldable panels 18 each one being defined by a pair of parallel cut lines 20 on each side opposite one another and intersecting with a center cut line 22 in the general shape of an "T". Moreover, perforations forming score lines 24 are formed in the primary sheet 14 intersecting the distal ends of each of the cut lines 20 for hingeably joining the generally rectangular or square panels 18 formed therein to the primary sheet 14.

The support members 16 are likewise made of strips 30 of double fluted corrugated board having four score lines 32 spaced apart from one another normal to the longitudinal axis. The strips 30 are folded into square or rectangular formation so that the distal ends 34 and 36 respectfully join at a point 40 between the corners, preferably in the center section of the square support member 16. The wall thickness and size of the support members 38 vary depending upon the weight of the load supported and the number of support members 16 utilized.

Figure 4:
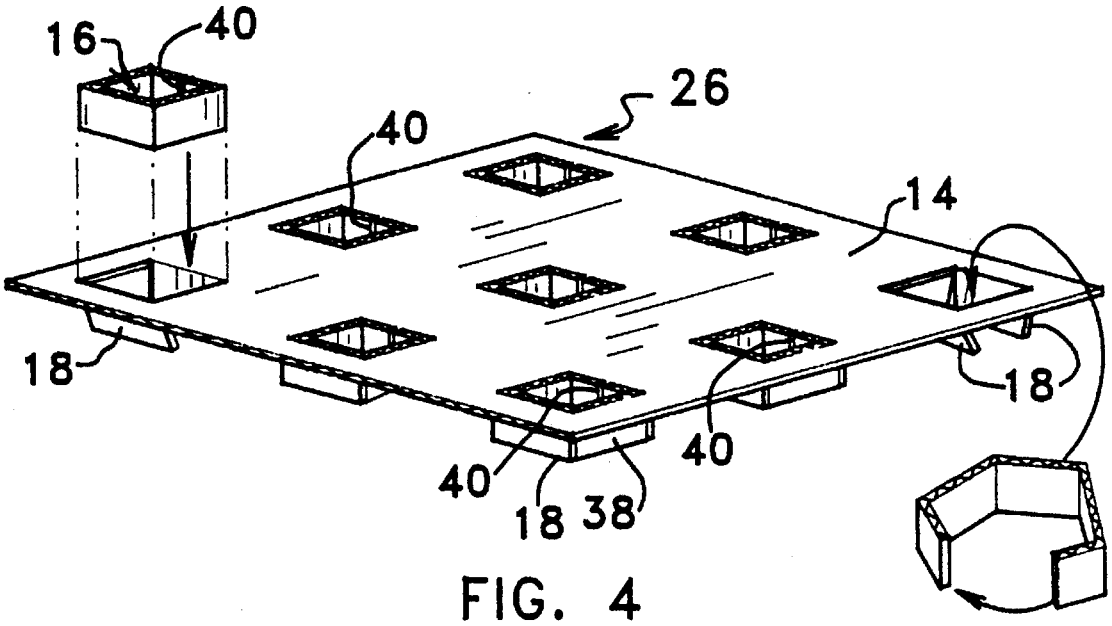
FIG. 4 is an elevational perspective view showing insertion of support members through the template cut and scored in the primary sheet pushing the portion of the primary sheet along the centercut downward and simultaneously bending the primary sheet along the crease scored therein.
Figure 5:
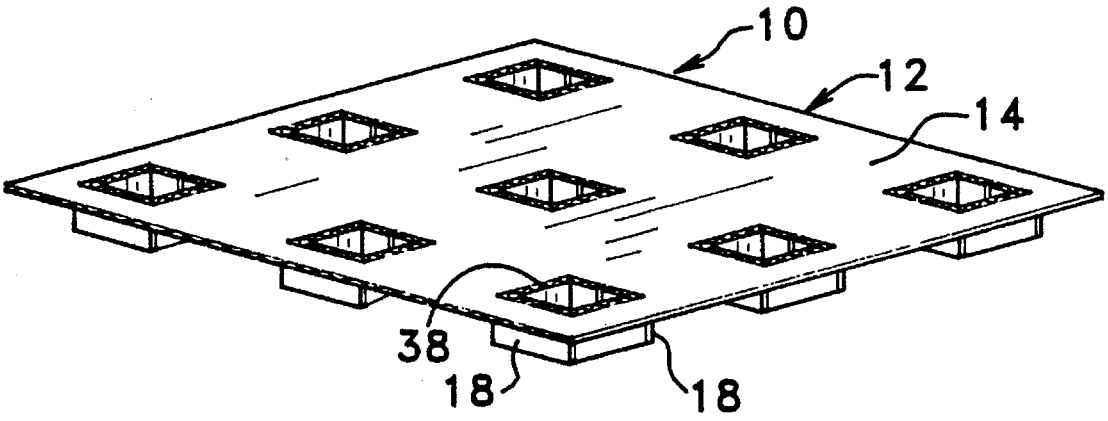
FIG. 5 is an elevational perspective view showing the single sheet corrugated pallet of the present invention.

As best illustrated in FIG. 4, exertion of pressure upon the surface of the panel template by insertion of a support member 16 forces the foldable panels 18 downward opposite one another and normal to the surface of the primary sheet 14 forming a pair of opposing panel legs 26. The support members 16 are rotated and positioned between the panel legs 26 so that the point 40 of junction of the distal ends 34, 36 of the support member 16 are adjacent one of the foldable panel 18.

Figure 23:
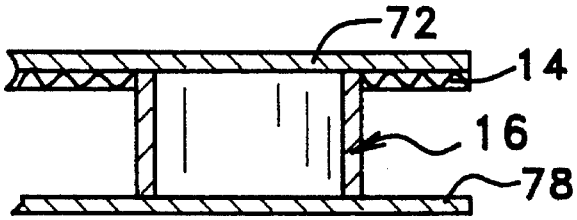
FIG. 23 is a sectional view taken along lines 23—23 showing the sides of the support member disposed between a pair of foldable panels.
Figure 24:
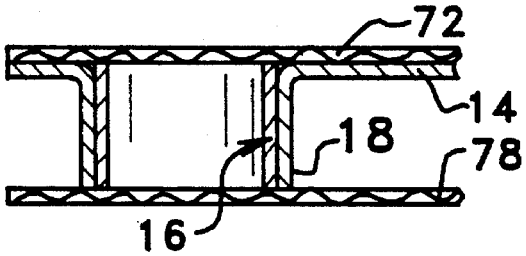
FIG. 24 is a sectional view taken along lines 24—24 showing the sides of the support member between the sides of the primary sheet panels.
Figure 29:
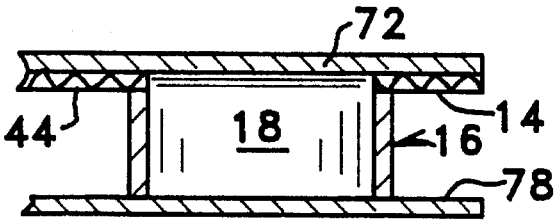
FIG. 29 is a sectional view taken along lines 29—29 showing the sides of the support member around the panels.
Figure 30:
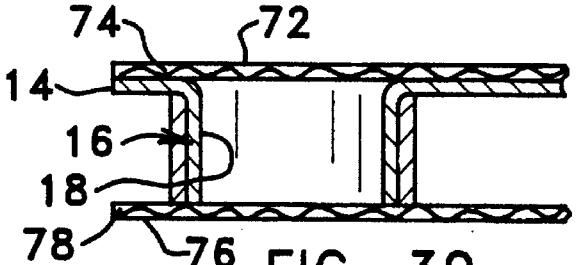
FIG. 30 is a sectional view taken along lines 30—30 showing the sides of the support member surrounding the sides of the primary sheet panels.

The support members 16 may be attached to the panel legs 26 by various fastening means such as by staples, rivets, or clips; however, in the preferred embodiment, a glue is used as an adhesive to hold the opposing panel legs 26 securely to the support members 16. In the preferred embodiment, the support leg members 16 are sized and shaped to provide a complementary fit with the panel legs 26. Insertion of the support members 16 within the panel legs 26 provides a reinforcing structure in that for the depth of the support members 16 extends the length of the panel legs 26 and the thickness of the primary panel 14 in order to provide optimal support for the load such as best shown in FIGS. 23–24. Surrounding or wrapping the panel legs 26 with a support member 16 provides a reinforcing structure in that the depth of the support members 16 extends the length of the panel legs 26 less the thickness of the primary panel 14, so that the top edge of the support members 16 support the bottom surface of the primary panel 14 around the opening formed by the panels 18 to provide optimal support for the load and alleviate stress at the junction of the panel legs 26 to the primary panel 14 such as is shown best in FIGS. 29–30. However, it is contemplated that the support members 16 may be of a depth of either more or less than that of the primary panel providing lateral side to side support and providing an edge or sidewall between the panel legs 26 and the supporting member to facilitate stacking of the corrugated pallets 10 one upon another such as is shown in FIGS. 37–40.

Figure 6:
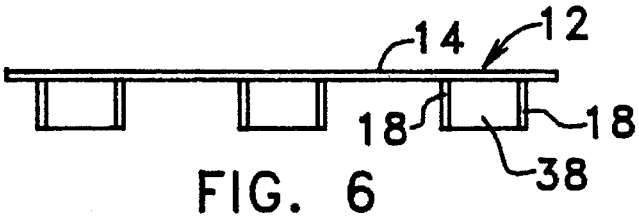
FIG. 6 is an elevational side view of the single sheet corrugated pallet showing the edges of the foldable panels comprising the support legs.
Figure 7:
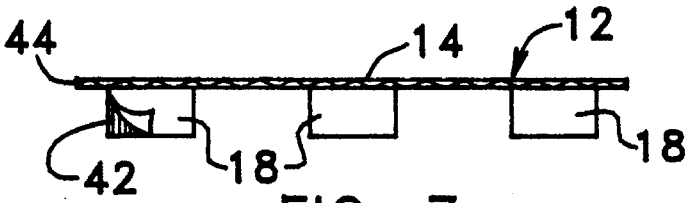
FIG. 7 is an elevational end view of the single sheet corrugated pallet of FIG. 1 showing the orientation of the panel flutes in alignment with the flutes in the primary sheet.
Figure 8:
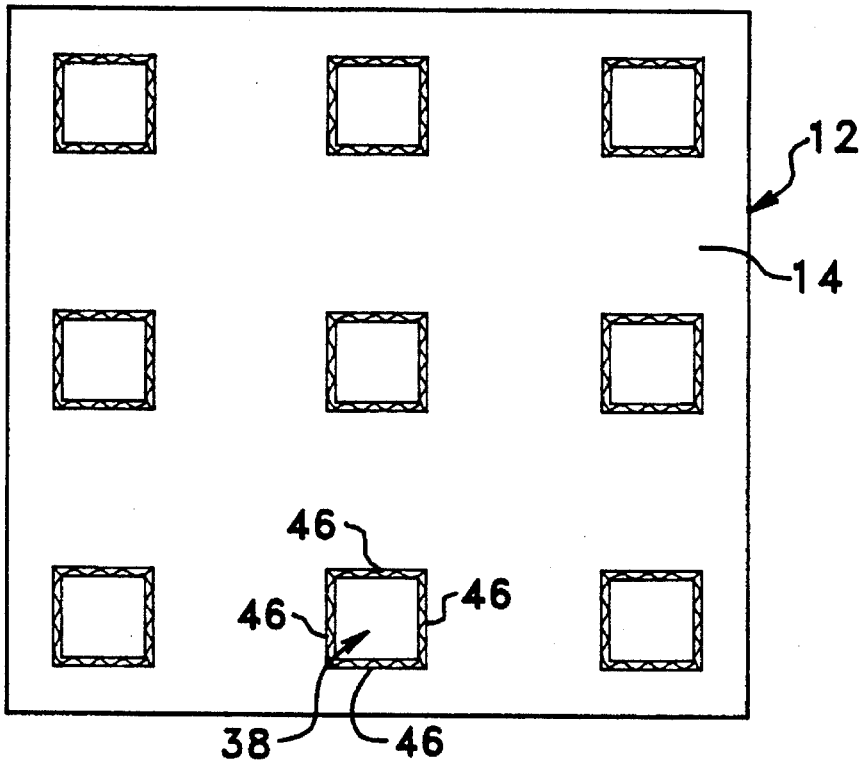
FIG. 8 is a plan top view of the single sheet corrugated pallet showing the fluted ends of the support members extending through the openings formed in the primary sheet.
Figure 9:
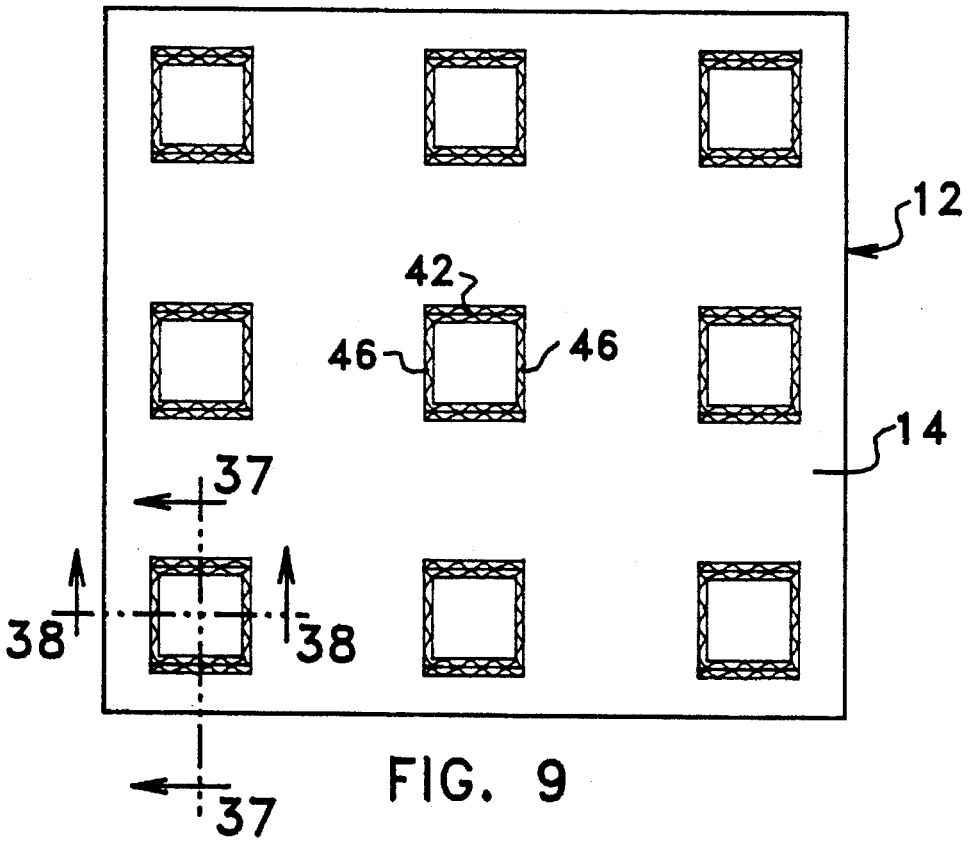
FIG. 9 is a plan bottom view of the single sheet corrugated pallet showing the fluted ends of the support members between the fluted panel ends.
Figure 10:
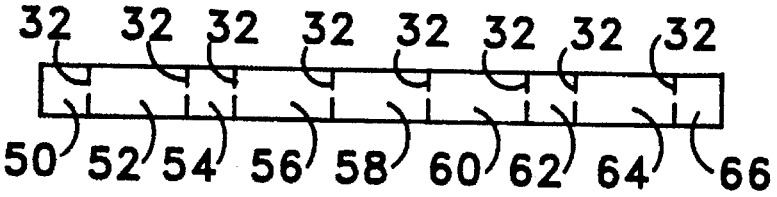
FIG. 10 is a front plan view showing a strip of corrugated material having a plurality of perforations therein forming score lines for foldably forming a support member having a reinforcement of a single sheet corrugated pallet.
Figure 11:
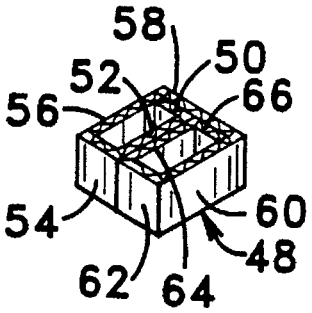
FIG. 11 is an exploded perspective view showing a reinforced support member of a single sheet corrugated pallet.
Figure 12:
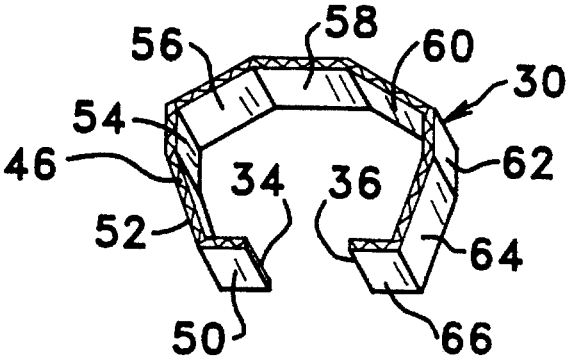
FIG. 12 is an elevational perspective view showing a reinforced support member of a single sheet corrugated pallet.
Figure 13:
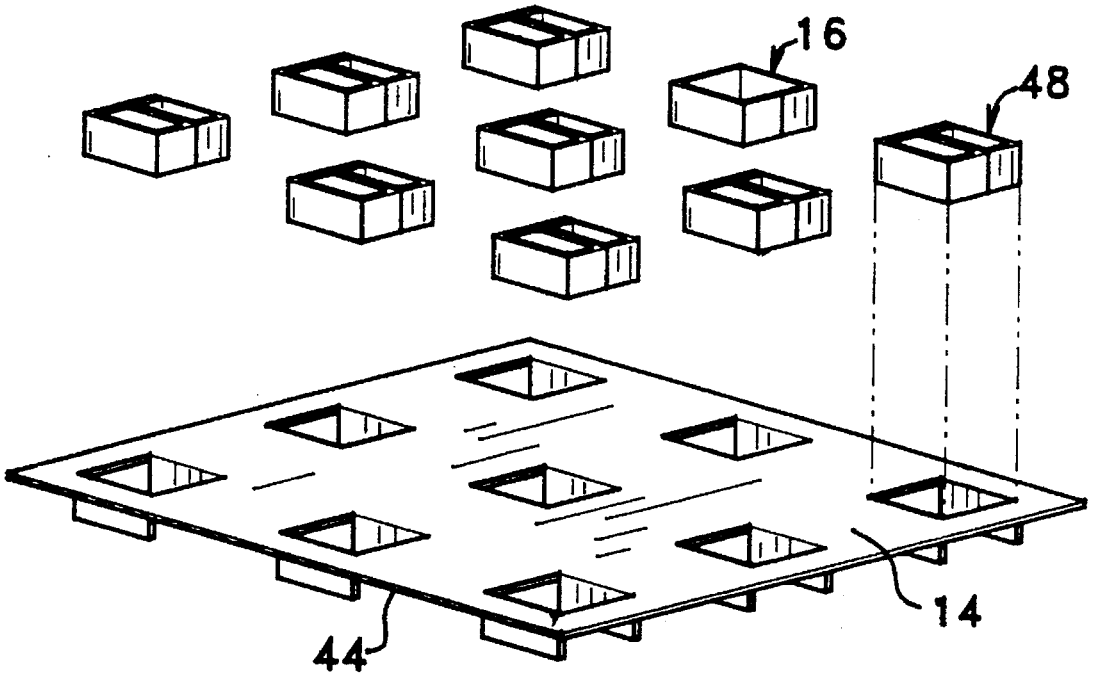
FIG. 13 is an explored perspective view showing alignment of the reinforced support members with the panels formed within the primary sheet of a single sheet corrugated pallet.

Moreover, as shown in FIG. 4, an adhesive such as water soluble or biodegradable glue is applied to the template surface of the primary sheet 14 before insertion of the support member 16. Insertion of the support members 16 through the primary panel 14 distributes the adhesive onto the surface of the support members 16 as the support members 16 are pushed through the marked template. FIG. 6 shows a side view of a single sheet corrugated pallet 12 showing the leg panels 16 secured to opposing sides of a support member 38. FIG. 7 shows an end view of a single sheet corrugated pallet wherein the flutes 42 of the foldable panels 18 are aligned with the flutes 44 of the primary sheet 14 so that the foldable panel flutes 42 extend normal to the supporting surface. FIG. 8 shows a plan top view of flutes 46 of the support members 38 extending through the primary sheet 14. FIG. 9 is a plan bottom view of the single sheet corrugated pallet 12 showing the fluted ends 46 of the support members 38 between the flutes 44 of the foldable panels 18. Furthermore it is contemplated that several layers of multiple ply sheets may be adhesively connected or FIGS. 10–12 show an alternate embodiment of a reinforced support member 48 fabricated from a strip 30 of corrugated material having eight score lines 32 extending normal to the longitudinal axis of the strip 30 forming strip sections (50, 52, 54, 56, 58, 60, 62, 64, and 66). The distal ends 34 and 36 are folded inwardly so that the outer surface of strip sections 50 and 66 are contiguous with and adhesively secured to the inner surface of strip section 58 thereby forming a "T"-shaped double layer reinforcing means within the reinforced support member 48. The reinforced support members 48 may be inserted into the primary panels 14, 48 instead of, or in addition to the square support members 16 such as is shown in FIG. 13.

Figure 14:
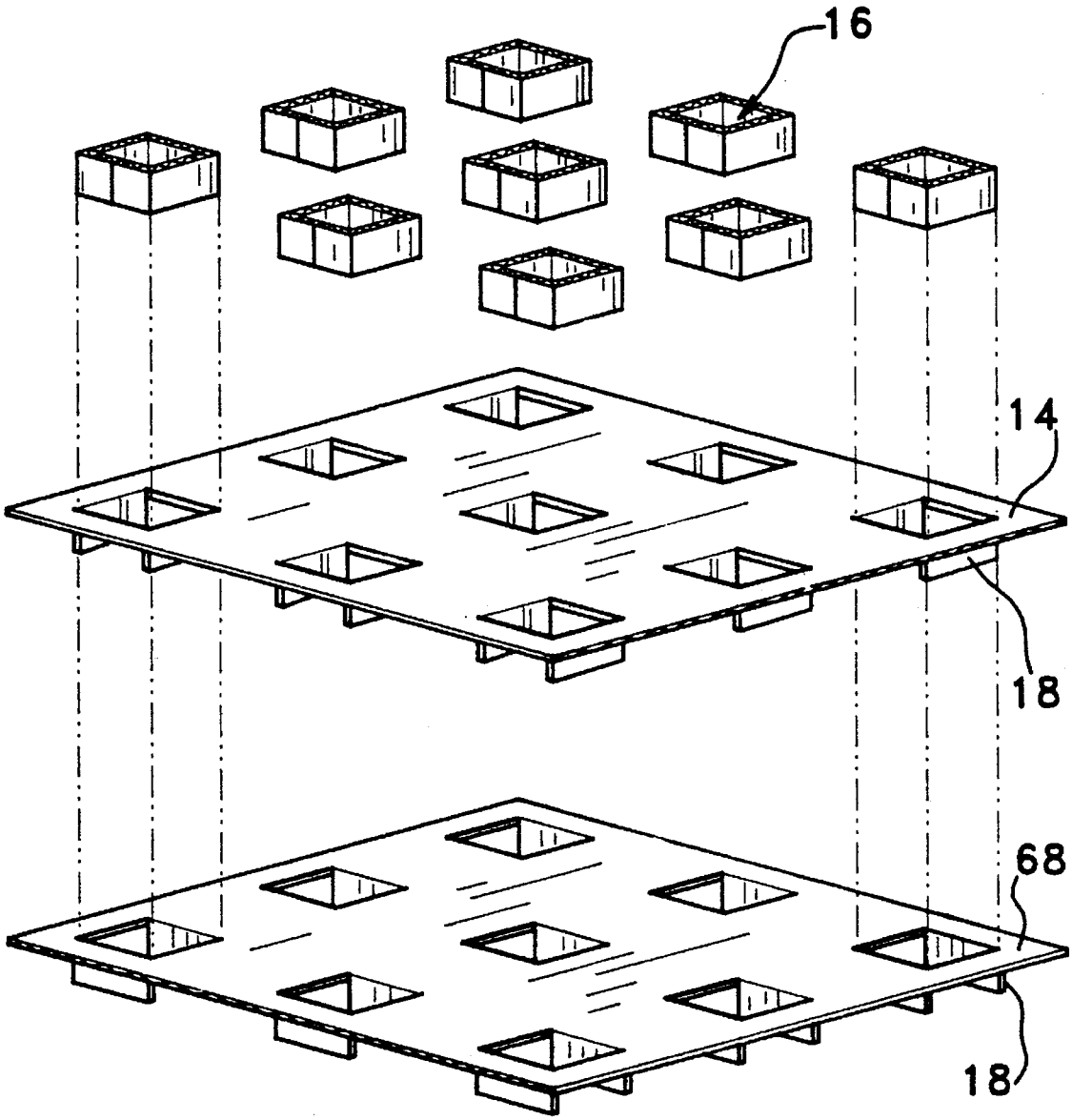
FIG. 14 is an elevational perspective view showing insertion of support members through the template cut and scored in a first primary sheet and a second primary sheet rotated on its axis 90 degrees with respect to the first primary sheet, pushing the portion of the primary sheets along the centercut downward and simultaneously bending the primary sheets along the crease scored therein forming four panel legs.
Figure 15:
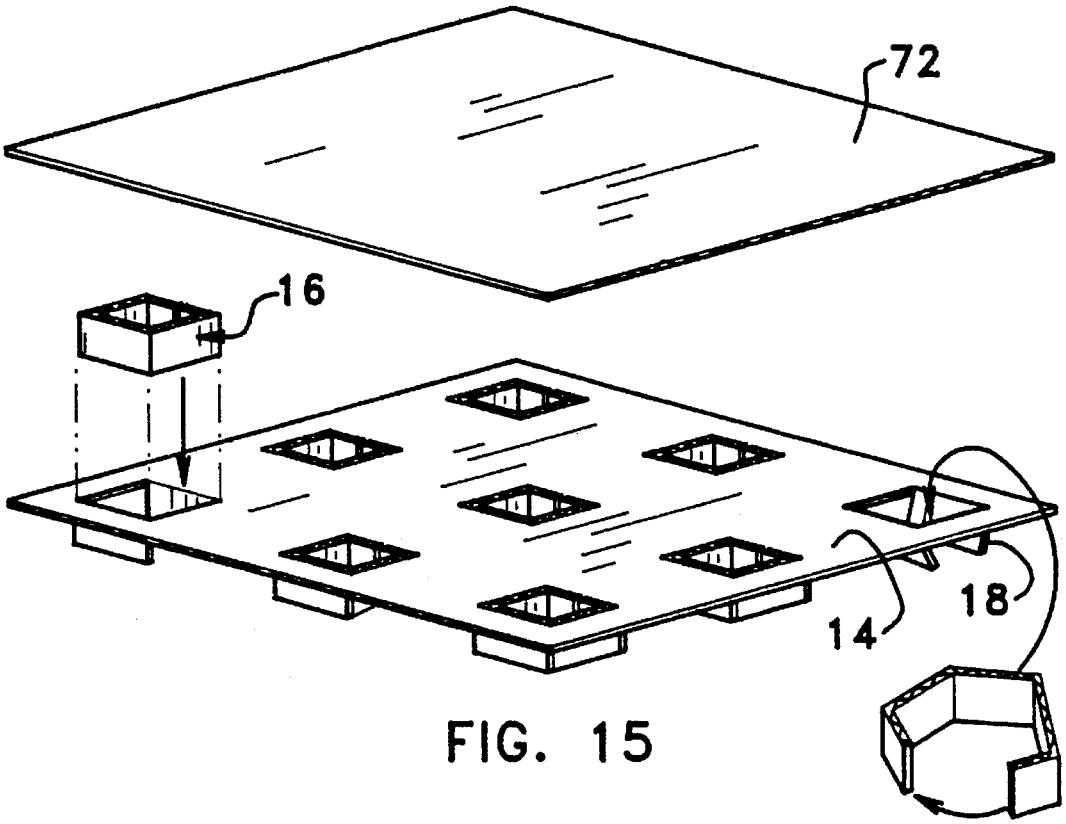
FIG. 15 an explored perspective view showing alignment of an support member between the panels formed in the primary sheet and the alignment of a top cover sheet forming a double sheet laminated corrugated pallet.

A second primary sheet 68 having identically panel templates formed by parallel cut lines 20, center cut lines 22 and score lines 32, may be rotated 90 degrees with respect to the first primary sheet 14 so that the cut and score lines of one sheet are perpendicular to the same cut and score lines of the other sheet. An adhesive is applied to the top surface of the first primary sheet 14 forming the bottom sheet. The second primary sheet 68 is stacked upon the first primary sheet 14 such that the squares of one are vertically juxtaposed upon the squares of the other sheet as shown in FIG. 14. Insertion of the support members 16, 48 through the sheets 14 and 68 depresses the foldable panels 18 downwardly and simultaneously spreads the adhesive from the surface of the first primary panel 14 and/or second primary panel 68 onto the outer surface of the support member 16 to securely hold the support member securely thereinbetween the four panel legs 26. This design forms a double sheet corrugated pallet 70 which maximizes the strength of the skid while minimizing the weight of the corrugated pallet 10.

Figure 16:
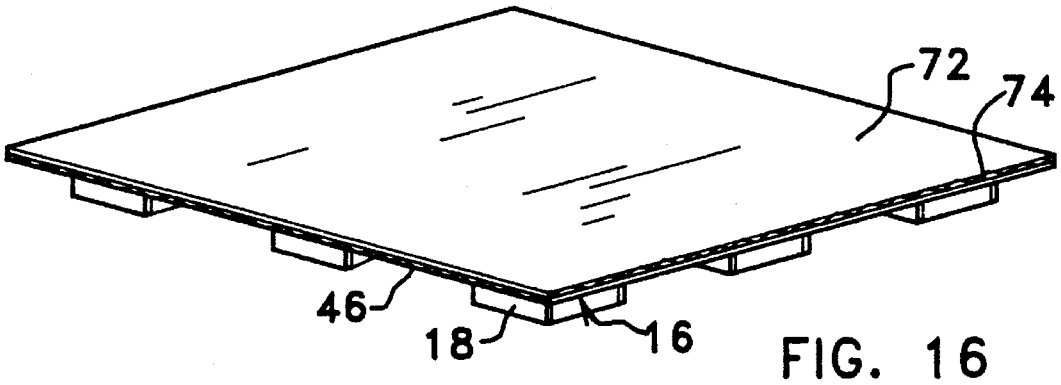
FIG. 16 is an elevated perspective view showing a double sheet laminated corrugated pallet of FIG. 15.
Figure 17:
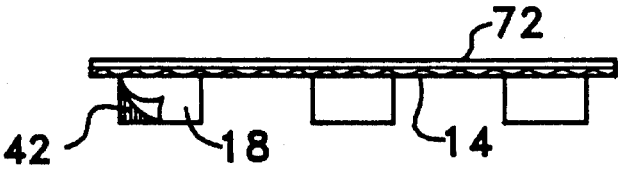
FIG. 17 is an elevational end view of the double sheet laminated corrugated pallet showing the orientation of the panel flutes in alignment with the lutes in the primary sheet.
Figure 18:
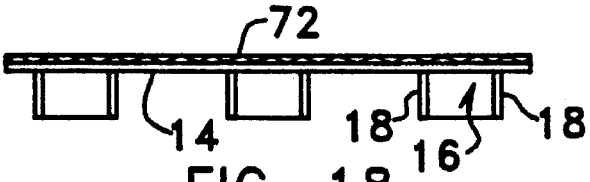
FIG. 18 is an elevational side view of the double sheet laminated corrugated pallet showing the edges of the panels attached to the support members.

As shown in FIGS. 15–18, an alternate embodiment of the present invention employs a first double fluted two ply laminate sheet 72 as a top cover sheet adhesively bonded to the surface of the primary sheet 14, 68, and the fluted edges 46 of the corrugated support members 16, 48. The laminate sheet is usually rotated 90 degrees before adhesion to the primary sheet 14, 68 so that the laminate sheet flutes 74 run perpendicular to the primary sheet flutes 44 to maximize the strength of the corrugated pallet 10 as shown in FIG. 16. The primary sheet flutes 44 run parallel with the foldable panel flutes 42 as illustrated in FIG. 17 and 18.

Figure 19:
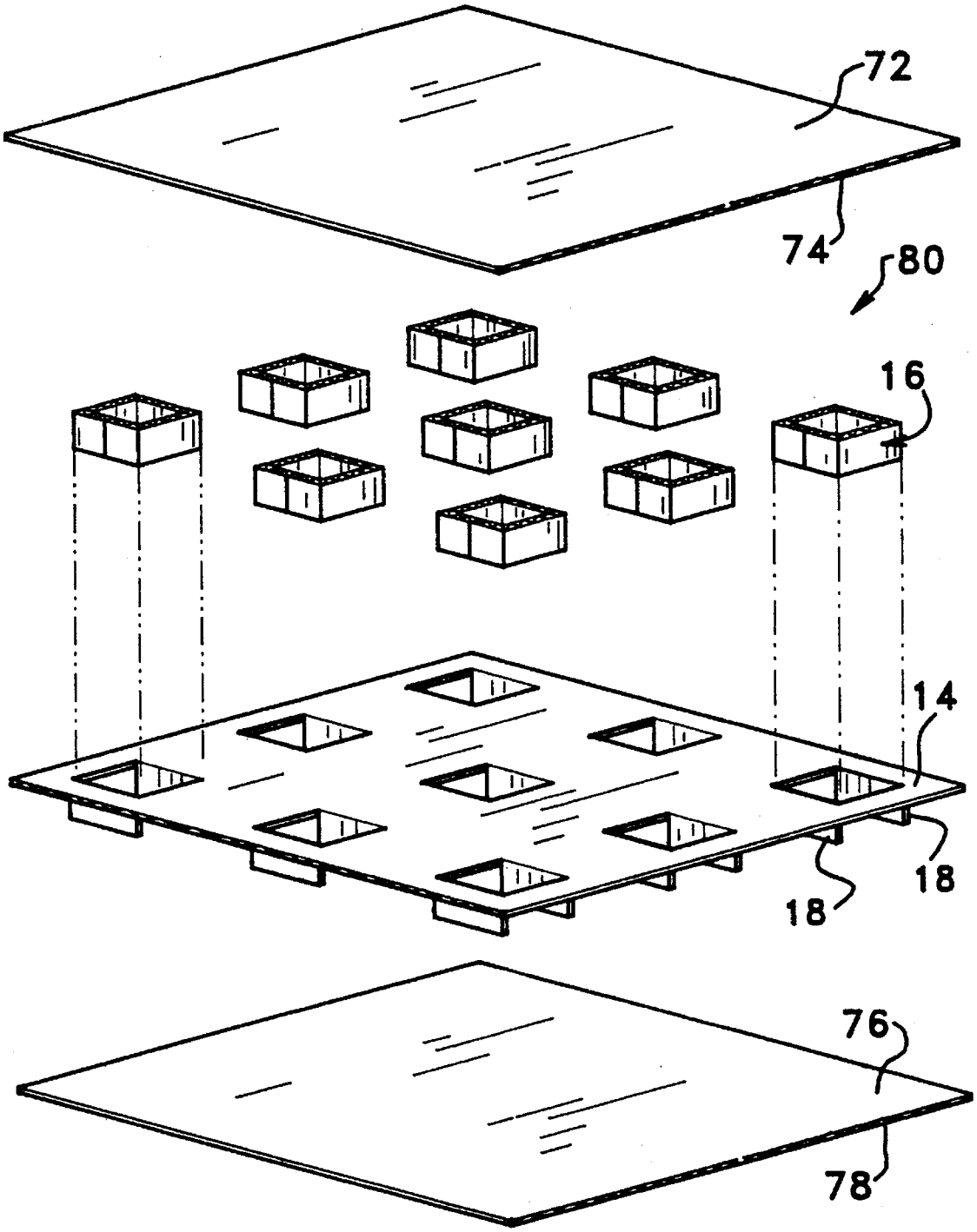
FIG. 19 is an explored perspective view showing alignment of a support member between the panels formed in the primary sheet, and the alignment of a top cover sheet and bottom base sheet forming a triple sheet laminated corrugated pallet.
Figure 20:
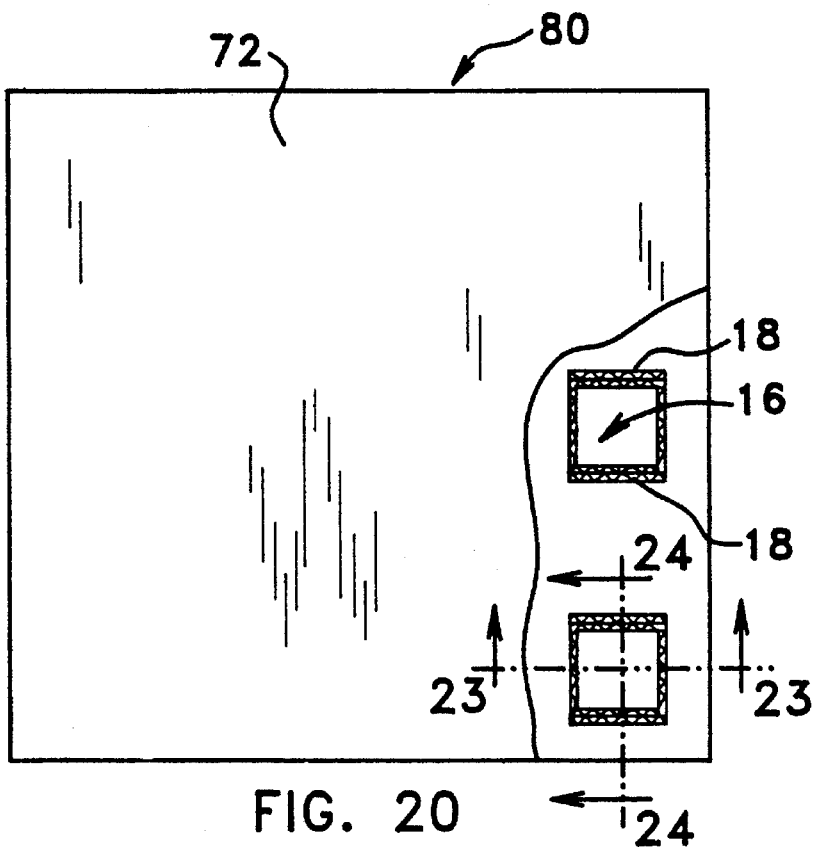
FIG. 20 is a top plan view of FIG. 19 depicting a cut-away section showing the flutes of the primary sheet panels and support members therein.
Figure 21:
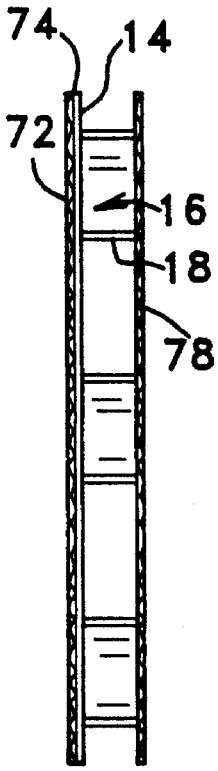
FIG. 21 is a right side view of FIG. 19 showing the flutes of the top cover sheet running parallel with the panels of the bottom base sheet and normal to the flutes of the primary sheet.
Figure 22:
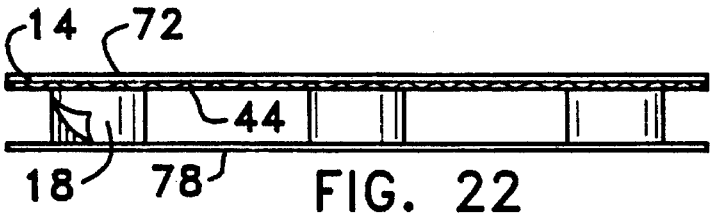
FIG. 22 is an end view of FIG. 19 showing the primary sheet and panel flutes.

Moreover, as shown in FIG. 19, a fluted double ply laminated base sheet 76 may also be adhesively secured to the edges of the panel legs 28 and edges of the support members 16 secured therein forming a triple double fluted two ply laminated sheet corrugated pallet 80. As with the top sheet, the laminate base sheet 76 is usually rotated 90 degrees before adhesion to the primary sheet 14, 68 so that the laminate sheet flutes 74 run perpendicular to the primary sheet flutes 44 to maximize the strength of the triple sheet corrugated pallet 80. As illustrated in FIG. 21, the first laminate sheet flutes 74 run parallel with the laminate base sheet flutes 78 opposite the primary sheet flutes 44 and foldable panel flutes 42 as shown in FIGS. 22–24.

An alternate embodiment of the present invention is shown in FIGS. 25–30, comprising a laminated base sheet 76 adhesively secured to the edges of the panel legs 28 and edges of the support members 16 adhesively secured around the panel legs 28 forming a triple sheet laminated corrugated pallet 80. The top laminate sheet 72 and the laminate base sheet 76 are generally rotated 90 degrees before adhesion to the primary sheet 14, 68 so that the laminate sheet flutes 74 run perpendicular to the primary sheet flutes 44 to maximize the strength of the triple sheet corrugated pallet 80. As illustrated in FIGS. 25–30, the first laminate sheet flutes 74 run parallel with the laminate base sheet flutes 78 opposite the primary sheet flutes 44 and foldable panel flutes 42.

Figure 25:
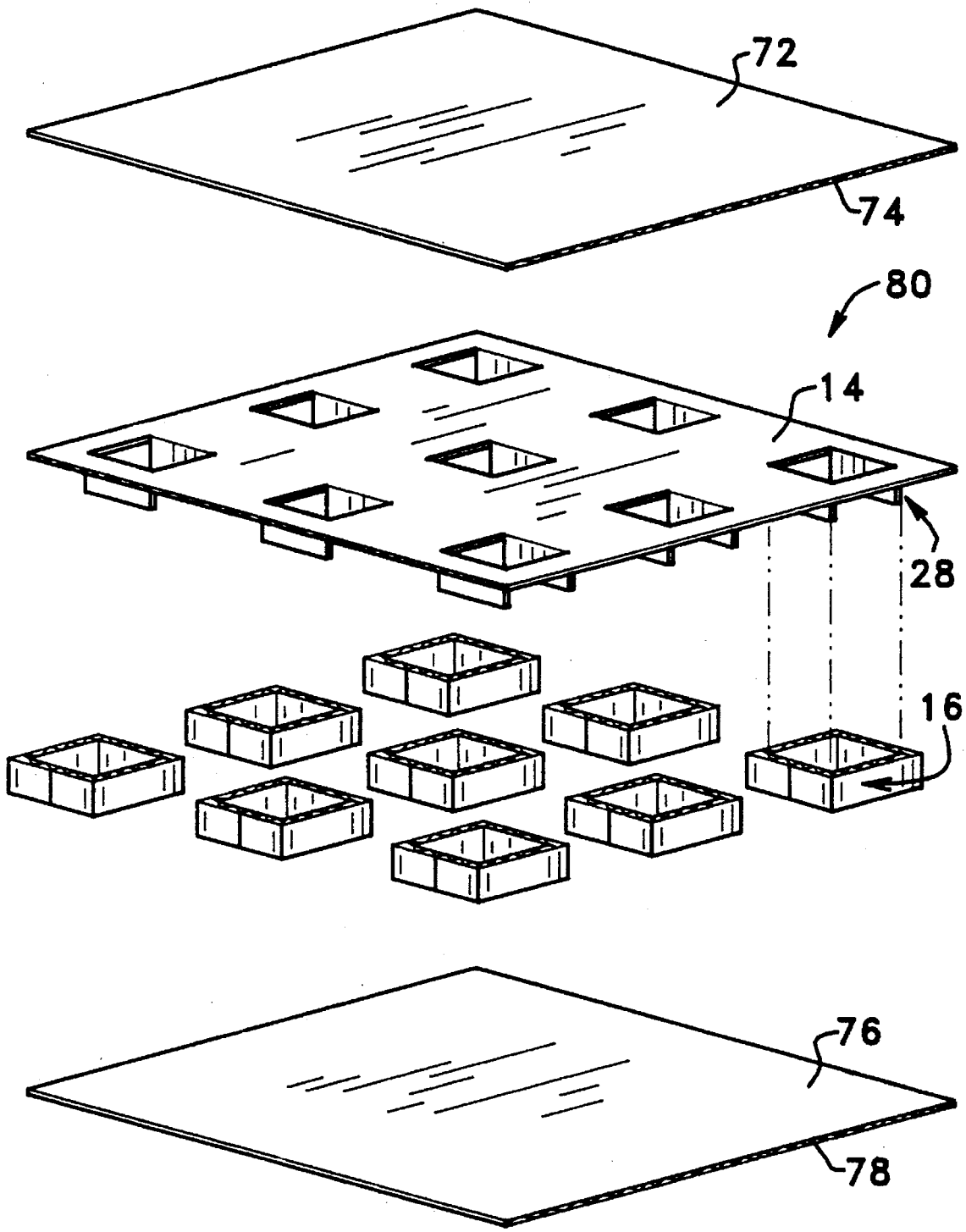
FIG. 25 is an explored perspective view showing alignment of support members around the panels formed in the primary sheet, and the alignment of a top cover sheet and bottom base sheet forming a triple sheet laminated corrugated pallet.
Figure 26:
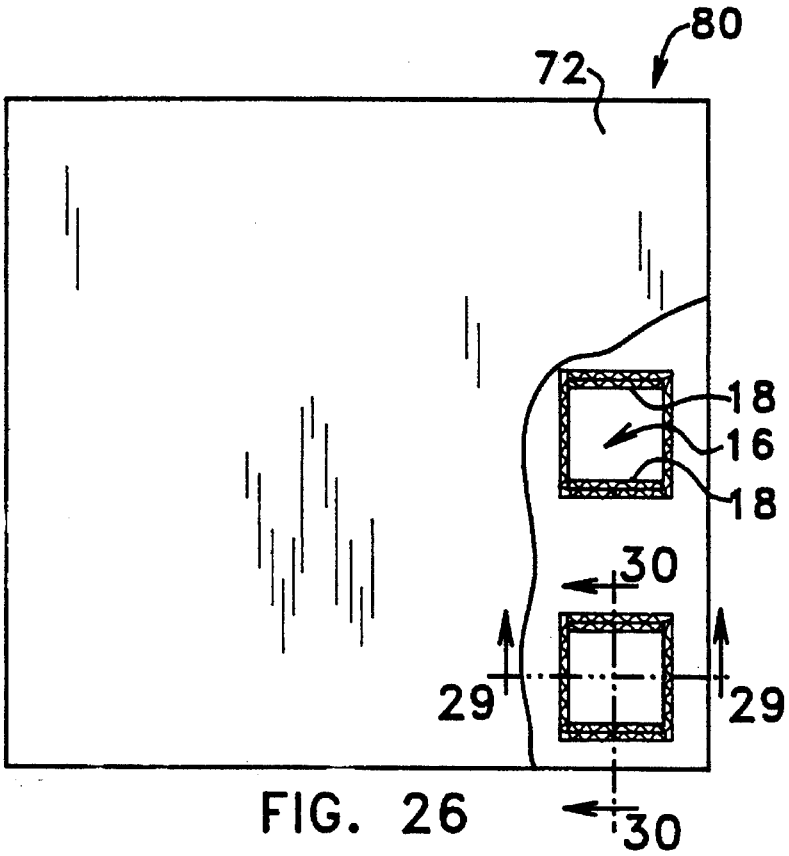
FIG. 26 is a top plan view depicting a cut-away section showing the flutes of the primary sheet panels surrounded by the support members.
Figure 27:
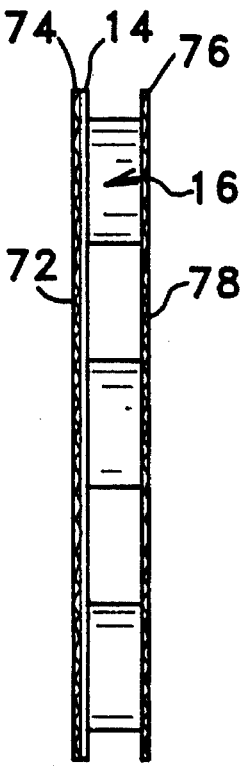
FIG. 27 is a side view of FIG. 26 showing the flutes of the top cover sheet running parallel with the panels of the bottom base sheet and normal to the flutes of the primary sheet.
Figure 28:
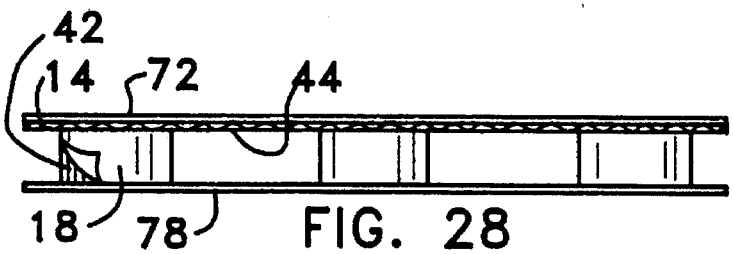
FIG. 28 is an end view of FIG. 26 showing the primary sheet and panel flutes.
Figure 31:
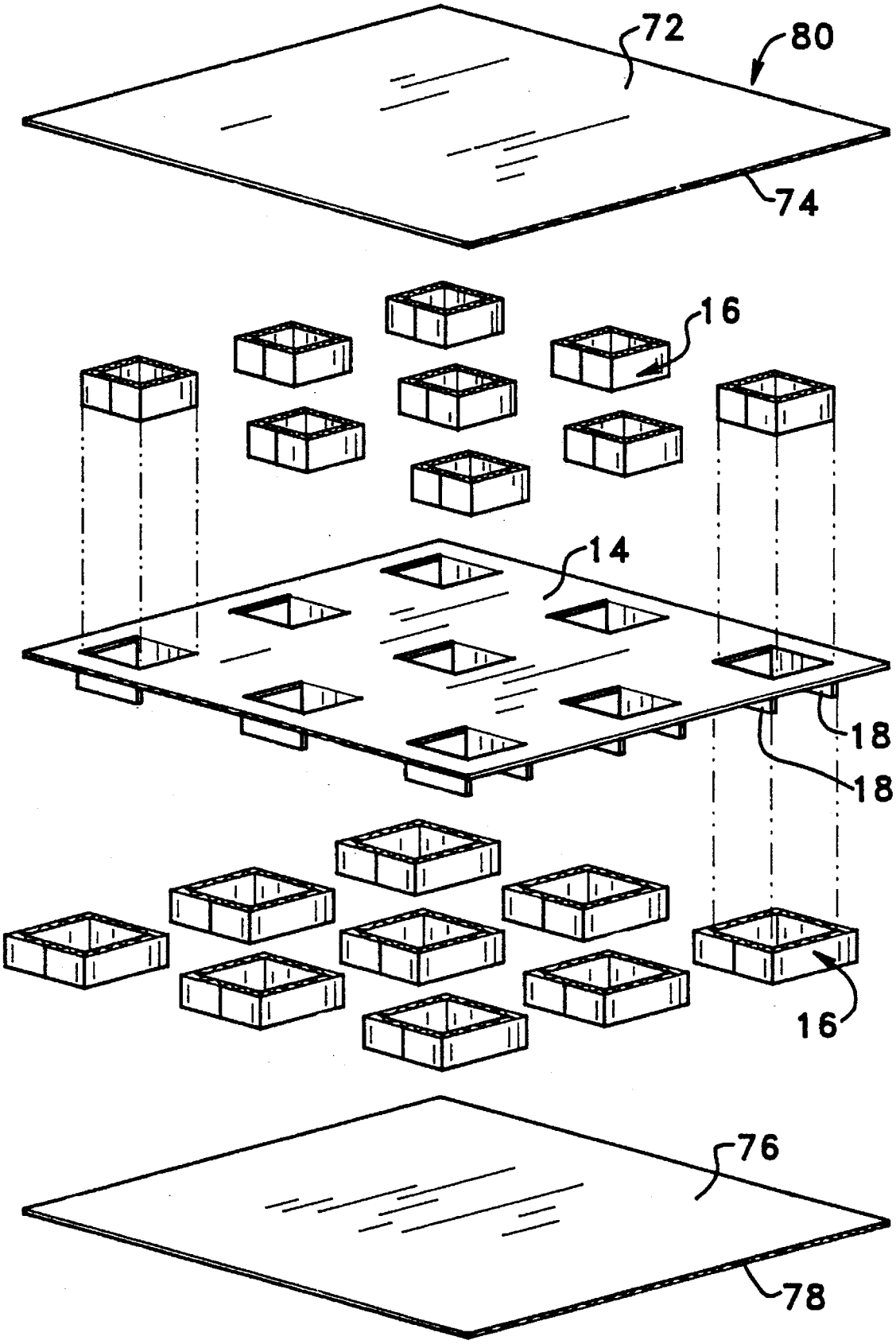
FIG. 31 is an explored perspective view showing alignment of support members within the primary sheet panels and support members around the primary sheet panels, and the alignment of a top cover sheet and bottom base sheet forming a triple sheet laminated corrugated pallets.

Another embodiment of the present invention combines the features of the triple sheet corrugated pallet 80 shown in Figures 19 and 25, by utilizing support members 16 inserted within and adhesively secured between the inner surfaces of the foldable panels 18, in conjunction with support members 16 surrounding and adhesively secured to the outer surface of the foldable panels 18 as best illustrated in FIG. 31.

Figure 32:
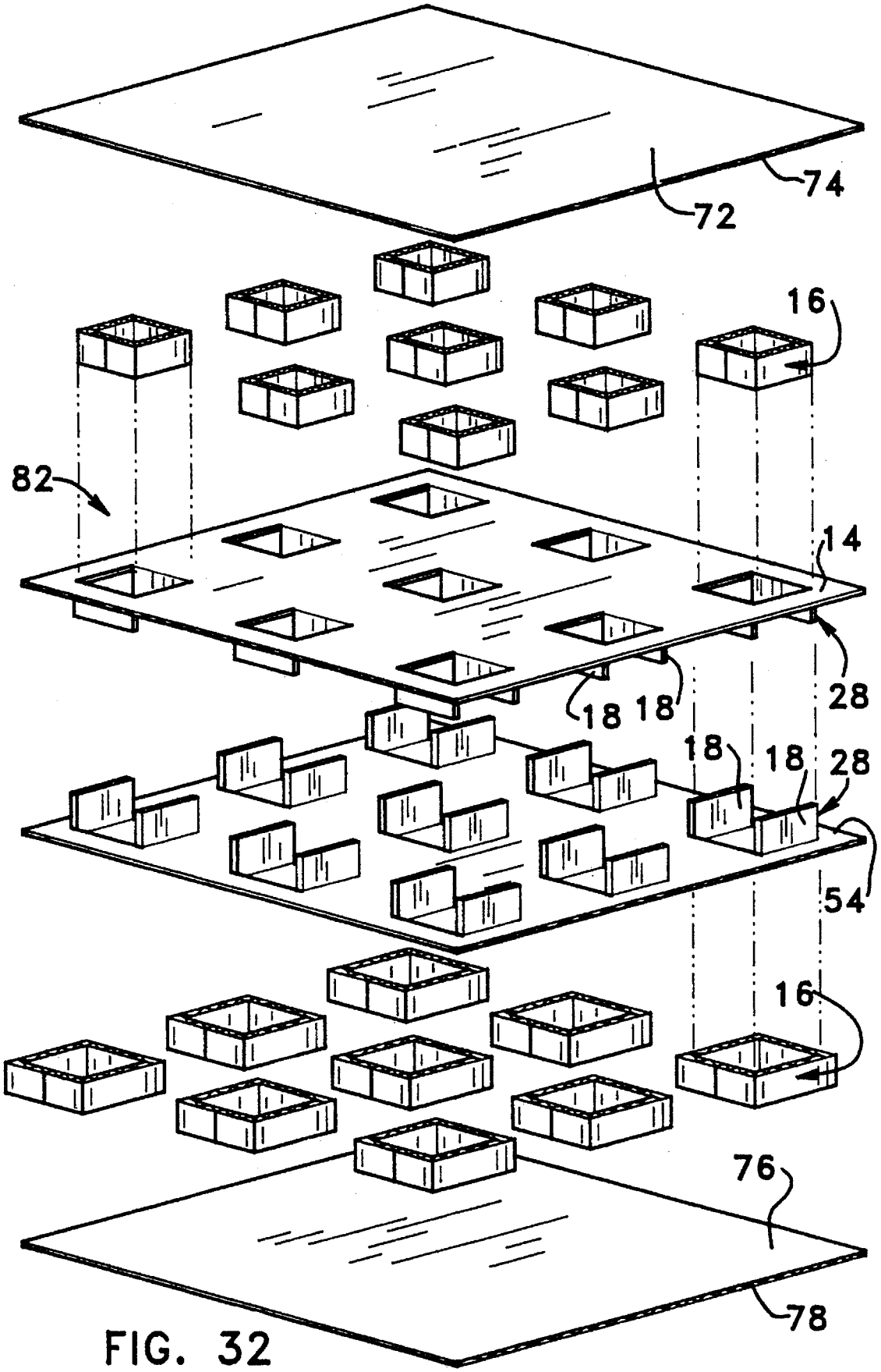
FIG. 32 an elevational perspective view showing insertion of support members through the template cut and scored in a first primary sheet and an inverted second primary sheet rotated on its axis 90 degrees with respect to the first primary sheet forming four panel legs thereinbetween, wherein the first and second primary sheets are sandwiched between a top cover sheet and bottom base sheet.

Furthermore, an alternate version of the present invention is shown in FIG. 32 comprising a quadruple sheet corrugated pallet 82 which utilizes the same aforementioned first primary panel 14 and second primary sheet 68 as shown in FIG. 14; however, the second primary sheet 68 is inverted and rotated 90 degrees with respect to the first primary sheet 14 so that the cut and score lines of one sheet are perpendicular to the same cut and score lines of the other sheet. The second primary sheet 68 is stacked upon the first primary sheet 14 such that the squares of one are vertically juxtaposed upon the squares of the other sheet so that the foldable panels 18 of the first primary sheet 14 extend through the openings formed in the second primary sheet 46 and vice versa. Insertion of inner support members 16 through the sheets 14 and 68 from above or below depresses the foldable panels 18 and simultaneously spreads the adhesive from the surface of the first primary sheet 14 and/or second primary sheet 46 onto the outer surface of the support member 16 to securely hold the support member 16 securely thereinbetween the four panels 18 forming the panel legs 26. The outer support members 16 is positioned around and adhesively attached to the panel legs 26 in conjunction with the inner support members 16 to provide additional structural support. Moreover, the first laminate sheet 54 forms a cover sheet which is adhesively secured to the edges of the inner and outer support members 16 and the surface of the primary sheet 14. A laminate base sheet 76 is adhesively secured to the bottom edges of the support members 16 and the surface of the second primary sheet 68. It is contemplated that several laminate sheets 54 may be stacked together in combination with the primary sheets 14, 68 and support members 16, to provide a simple, inexpensive, and efficient method of increasing the strength to weight ratio of the corrugated pallet 82.

Figure 33:
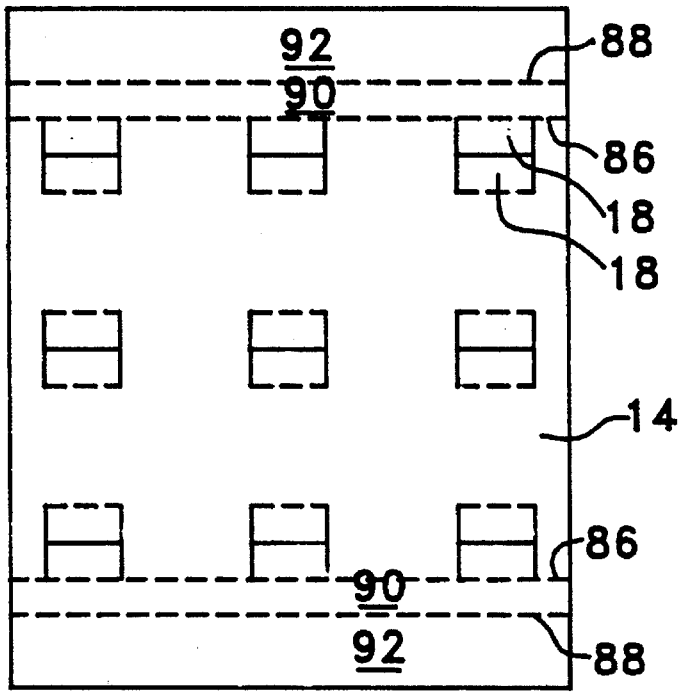
FIG. 33 a top plan view of showing a primary sheet having a plurality of perforations and scores therein forming side runners therefrom.
Figure 34:
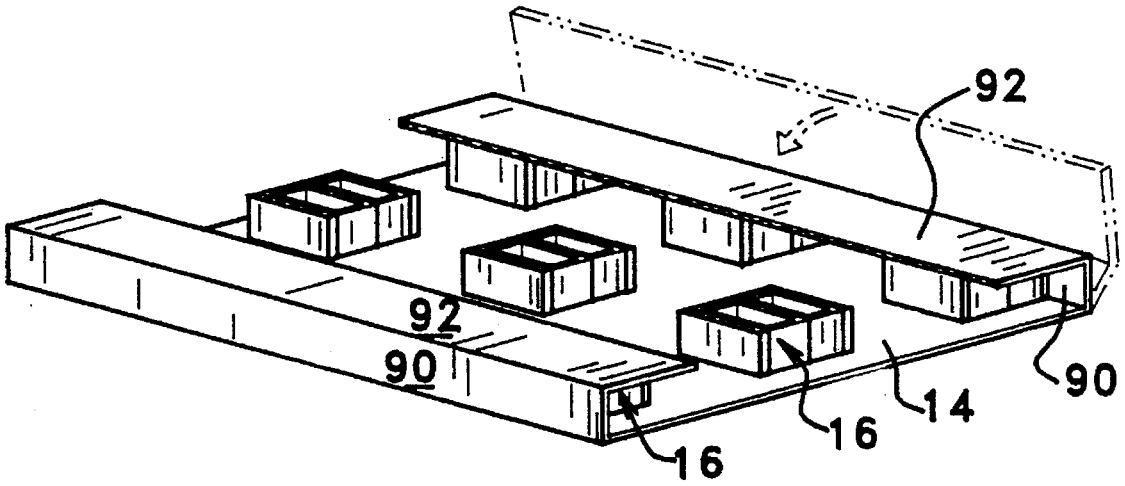
FIG. 34 is a bottom perspective view of FIG. 33 showing a single sheet corrugated pallet having a pair of outer panels folded downwardly and inwardly around the outer support members forming side runners.

As set forth in FIGS. 33 and 34, additional supporting structures such as side rails or side runners 84 may be fabricated in combination with the folding panels 18 from a single primary sheet 14 or base sheet 76. The side runners 84 add substantial lateral stability and extra strength around the edge of the corrugated pallet 10 which is subjected to the greatest load strain and stress. Furthermore, the side runners 84 perform as guide runners guiding the lift truck forks and providing a means for orienting the skids during stacking. As shown in the drawings, the sheet 14 is perforated with a pair of spaced apart parallel score lines consisting of inner score line 86 and outer score line 88 forming an inner panel 90 and outer panel 92 on each side of the primary sheet 14. The score line for the inner panel 90 is positioned near the score line of the outer support members 16 or support legs 26. As shown in FIG. 34, support members 16 or reinforced support members 48 are inserted and adhesively secured in-between or around the panel legs 26 of a primary sheet 14 or adhesively affixed to the bottom of a base sheet 76. The inner panels 90 and outer panels 92 are folded inwardly around the outer side panel legs 26 and support members 16 therein or therearound forming side rails 84 on each side of the corrugated pallet 10. It is contemplated that a laminate base sheet 76 and/or laminate top sheet 72 may be used in combination with the primary sheet 14 having side runners 84.

Figure 35:
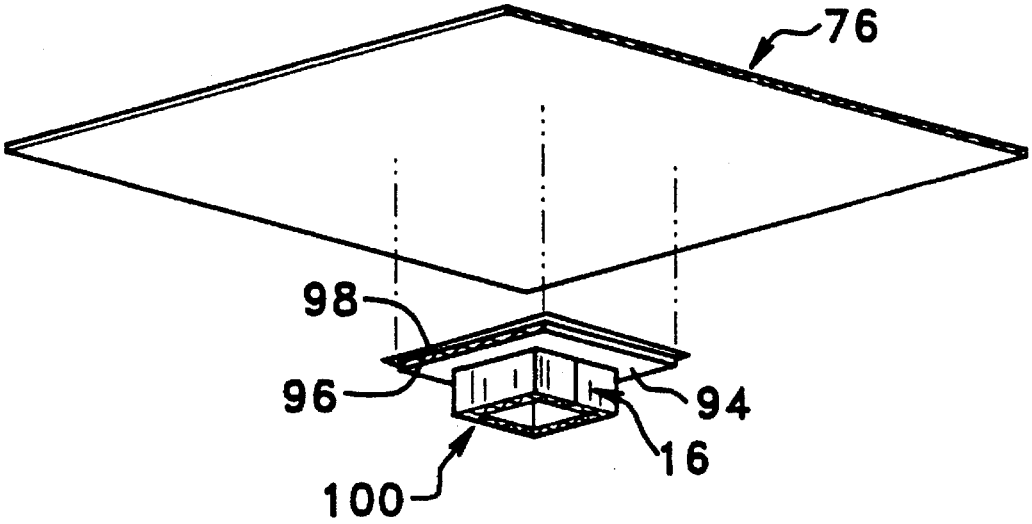
FIG. 35 is a perspective view of a support base member.
Figure 36:
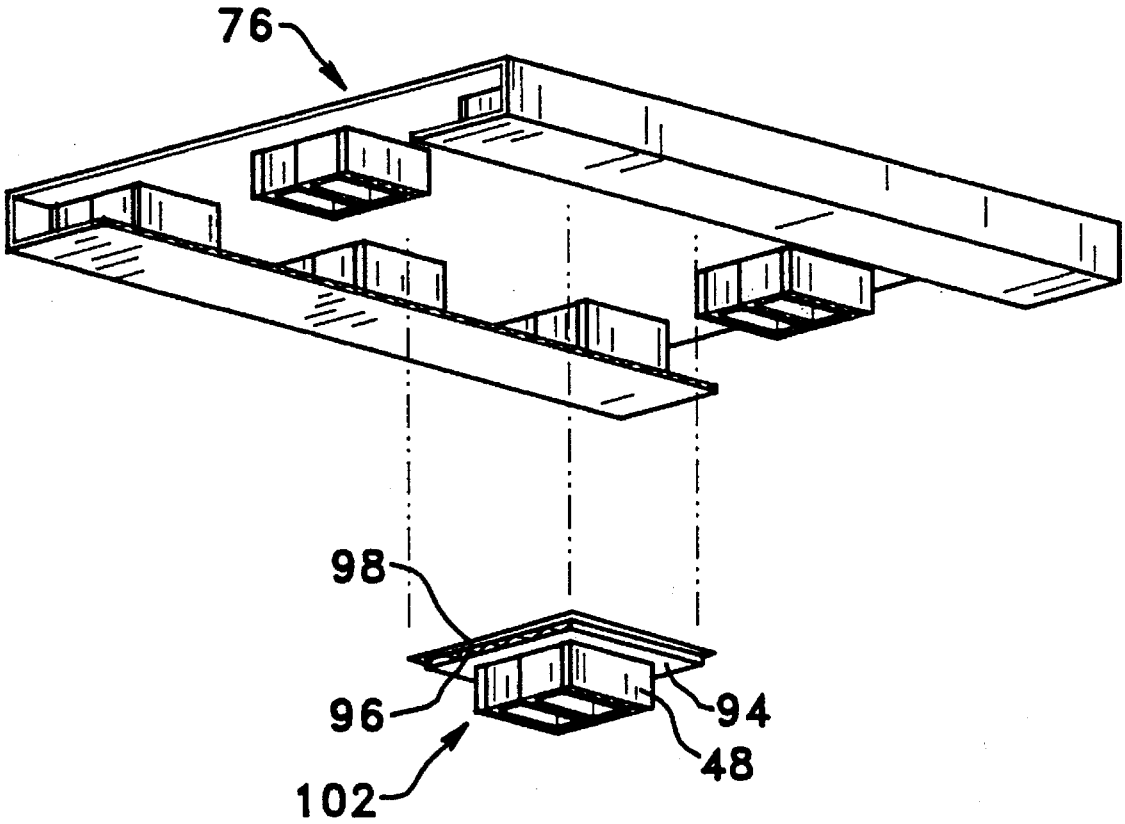
FIG. 36 is a perspective view of a reinforced support base member.
Figure 37:
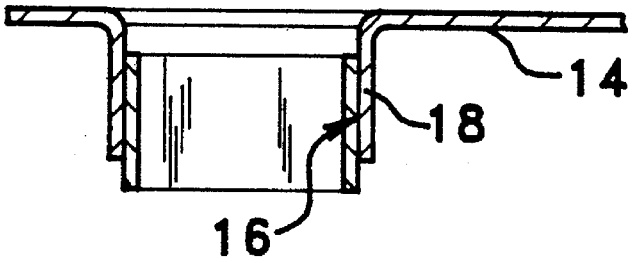
FIG. 37 is a sectional view taken along lines 37—37 of FIG. 9 showing the sides of the support member extending below the surface of the primary panel disposed between a pair of foldable panels.
Figure 38:
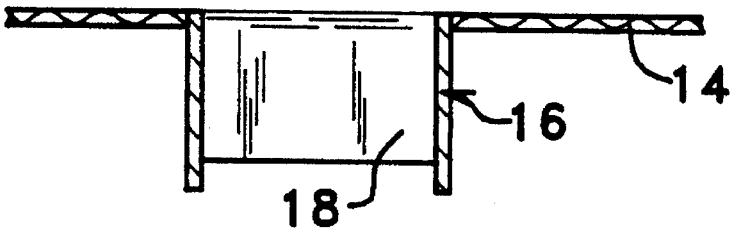
FIG. 38 is a sectional view taken along lines 38—38 of FIG. 9 showing the sides of the support member extending below the surface of one of the primary panels.
Figure 39:
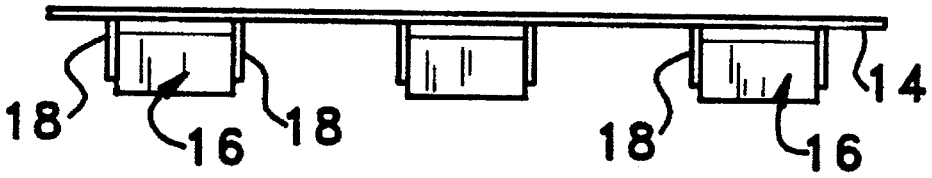
FIG. 39 is an elevated side view showing the sides of the support member extending below the surface of the primary panel disposed between a pair of foldable panels.
Figure 40:
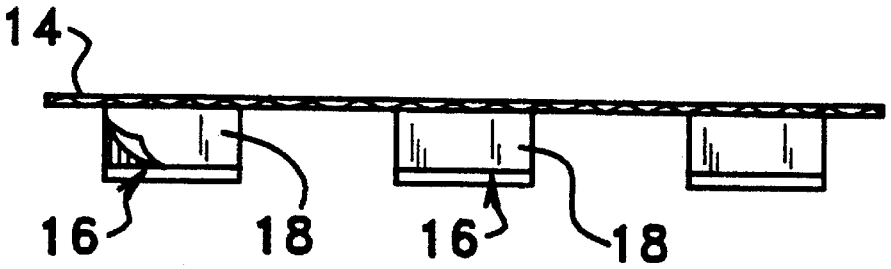
FIG. 40 is an elevated end view showing the support member extending below the surface of one of the primary panels.

The support members 16 and reinforced support members 48 may also be adhesively secured to a pre-cut panel of flat corrugated material 94 having an adhesive backing 96 covered with a nonstick film, or waxed paper material 98 forming an independent support base member 100 or reinforced support base member 102 as shown in FIGS. 35 and 36. The base member 100 can be attached to the bottom of a primary sheet 14 for additional structural support or a plurality of base members 100 may be attached to the bottom of a base sheet 76 for support, for stacking, or for providing a means to hold the corrugated pallet 10 up off of the floor.

The foregoing detailed description is given primarily for clearness of understanding and no unnecessary limitations are to be understood therefrom, for modification will become obvious to those skilled in the art upon reading this disclosure and may be made without departing from the spirit of the invention and scope of the appended claims.

We claim:

1. A corrugated pallet comprising:

a primary sheet of flat corrugated material having a plurality of pairs of opposing panels formed integrally therein, each of said pair of opposing panels being hingeably connected to said primary sheet, each of said opposing panels being folded downwardly normal to the surface of said primary sheet defining a pair of opposing panel support legs having an inner surface and outer surface, being formed of corrugated material having flutes oriented normal to the surface of said primary sheet, and forming a generally square aperture in said primary sheet between said opposing panel support legs;

a support member secured to each pair of opposing panel support legs, said support member comprising a strip of corrugated material having a plurality of scores cut therein along the surface of one side for bending said strip into a corrugated support member having flutes oriented normal to the surface of said primary sheet and forming a generally square configuration defining four sides, a top fluted edge, a bottom fluted edge, and a generally open center, said support member being disposed within said aperture and thereinbetween said opposing panel support legs formed in said primary sheet; and means for fastening said sides of said support members to said inner surface of said opposing panel support legs for supporting said primary panel.

2. The corrugated pallet of claim 1, wherein said support members comprise a strip of corrugated material forming a first section, a second section, a third section, a fourth section, and a fifth section, and the distal end of said first section and the distal end of said fifth section join near the center of one side, said support member being sized and shaped for insertion between said opposing panel support legs.

3. The corrugated pallet of claim 1, including a second support members sized and shaped for wrapping around the outer periphery of said opposing panel support leg(s).

4. The corrugated pallet of claim 1, wherein said support members are secured to said opposing panel support legs by an adhesive.

5. The corrugated pallet of claim 4, wherein said adhesive is applied to the surface of said opposing panel support legs.

6. The corrugated pallet of claim 5, wherein said adhesive is spread to on the outer surface of said support member(s) by insertion of said support member(s) through the aperture formed in said primary sheet and the surface of said support member(s) is contiguous with the adhesive on the surface of said opposing panel support legs.

7. The corrugated pallet of claim 1, wherein the support members are made of corrugated board with the corrugations extending normal to said primary sheet.

8. The corrugated pallet of claim 1, including at least one cover sheet adhesively secured to said primary panel.

9. The corrugated pallet of claim 8, wherein said cover sheet is rotated 90 degrees with respect to said primary sheet so that the flutes of said primary sheet are positioned normal to the flutes of said cover sheet.

10. The corrugated pallet of claim 1, including a base sheet adhesively secured to a bottom surface of said opposing panel support legs and support members.

11. The corrugated pallet of claim 10, wherein said base sheet is rotated 90 degrees with respect to said primary sheet so that the flutes of said primary sheet are positioned normal to the flutes of said base sheet.

12. The corrugated pallet of claim 1, wherein said corrugated material comprises one or more sheets of fluted single, double, triple, quadruple ply corrugated paper.

13. The corrugated pallet of claim 1, wherein said opposing panel support legs are cut so that the hinge is normal to the direction of the flutes of said primary sheet and the flutes of said opposing panel extend parallel to the flutes in said primary sheet.

14. The corrugated pallet of claim 1, including a second primary sheet comprising a a) a flat corrugated material having a plurality of pairs of opposing panels formed therein, each of said pair of opposing panels being hingeably connected to said primary sheet, each of said opposing panels being folded downwardly normal to the surface of said primary sheet defining opposing panel support legs and forming an aperture in said primary sheet between said opposing panels; and means for fastening said support members to said support legs for supporting said primary panel;

b) said second primary sheet being rotated 90 degrees with respect to said first primary sheet so that said opposing panel support legs from said first primary sheet and said second primary sheet form a four sided opposing panel support leg; and c) means for fastening said second primary sheet to said first primary sheet.

15. The corrugated pallet of claim 14, wherein said means for fastening is an adhesive.

16. The corrugated pallet of claim 14, wherein said second primary sheet and opposing panel support legs are inverted and said opposing panel support legs of said second primary sheet are upwardly directed and positioned in alignment with and contiguous with said downwardly directed opposing panel support legs of said first primary sheet.

17. The corrugated pallet of claim 14, said support member comprising a strip of corrugated material having a plurality of scores extending normal to the longitudinal axis thereof forming a first section, a second section, a third section, a fourth section, and a fifth section folded inwardly so that the distal end of the first section meets with the distal end of the fifth section.

18. The corrugated pallet of claim 17, wherein said distal end of said first section and distal end of said fifth section join near the center of one side.

19. The corrugated pallet of claim 1, said support member comprising a strip of corrugated material having a plurality of scores extending normal to the longitudinal axis thereof forming a first section, a second section, a third section, a fourth section, a fifth section, a sixth section, a seventh section, an eighth section, and a ninth section folded inwardly so that the outer surface of the first section and ninth section are contiguous with the inner surface of the fifth section, and the outer surface of the second section is contiguous with the outer surface of the eighth section.

20. The corrugated pallet of claim 1, including a second support member(s) sized and shaped to wrap around the outer periphery of said opposing panel support legs.

21. The corrugated pallet of claim 1, wherein said primary sheet includes a pair of spaced apart parallel score lines forming an inner side panel and outer side panel on each side of said primary sheet, said support members being positioned near the score line of the inner side panel, said inner panels and said outer panels folding inwardly around said outer support members forming side rails extending along each side of said primary sheet.

22. The corrugated pallet of claim 1, wherein said primary sheet includes a pair of spaced apart parallel score lines forming an inner side panel and outer side panel on each side of said primary sheet, said support members being positioned near the score line of the inner side panel, said inner panels and said outer panels folding inwardly around said support members positioned near the sides of said primary sheet forming side rails extending along each side of said primary sheet.

23. The corrugated pallet of claim 1, including a base member comprising a support member or reinforced support member adhesively secured to a pre-cut panel of flat corrugated material having an adhesive backing thereon, said adhesive being covered with a nonstick film, or waxed paper material, said base member being adhesively attachable to the bottom of said primary sheet, said cover sheet, or said base sheet for additional structural support.

24. The corrugated pallet of claim 1, wherein insertion of said support members through said aperture in said primary sheet and between said opposing panel support legs extend the length of said opposing panel support legs and the thickness of said primary sheet for providing optimal support for the load supported thereon.

25. The corrugated pallet of claim 1, wherein wrapping or surrounding said support member around said opposing panel support leg(s) provides a reinforcing structure wherein the depth of said support member extends the length of said opposing panel support legs less the thickness of said primary sheet, so that a plurality of top edges of said support member supports the bottom surface of said primary sheet extending around said primary sheet aperture for providing optimal support for the load supported thereon and alleviate stress at a junction of said opposing panel support legs and said primary sheet.

26. The corrugated pallet of claim 1, wherein said support members are formed having a depth of either more or less than that of said primary sheet providing lateral side support and a supporting edge for stacking said pallets one on top of another.

27. A reinforced corrugated support base member comprising a pre-cut panel of flat corrugated material having an outer surface and an inner surface, said outer surface being covered with an adhesive, said adhesive on said outer surface being covered with a film of removable nonstick material and said inner surface being permanently affixed to an edge of a support member comprising a strip of corrugated material having a plurality of scores cut therein along an inner surface of one side of said strip for bending said strip into a rectangular loop, wherein said film of removable nonstick material covering said adhesive can be removed and said outer surface of said base support member is attachable to a bottom surface of a corrugated pallet providing structural support therefor.

28. The reinforced corrugated support base member of claim 27, wherein said support member comprises corrugated material including at least one strip of fluted single, double, triple, or quadruple ply corrugated material.

29. The corrugated pallet of claim 1, wherein said support member comprises corrugated material including at least one strip of fluted single, double, triple, or quadruple ply corrugated material.

* * * * *